US011965227B1

(12) United States Patent
Zhong et al.

(10) Patent No.: US 11,965,227 B1
(45) Date of Patent: Apr. 23, 2024

(54) METAL CERAMIC AND PREPARATION METHOD THEREOF

(71) Applicants: Chongyi Zhangyuan Tungsten Co., Ltd., Ganzhou (CN); Ganzhou Achteck Tool Technology Co., Ltd., Ganzhou (CN)

(72) Inventors: Zhiqiang Zhong, Ganzhou (CN); Lei Yin, Ganzhou (CN); Yan Xue, Ganzhou (CN); Zhuopeng Tan, Ganzhou (CN); Bangming Chen, Ganzhou (CN); Yanyuan Tang, Ganzhou (CN); Guozuan Xu, Ganzhou (CN)

(73) Assignee: CHONGYI ZHANGYUAN TUNGSTEN CO., LTD., Ganzhou (CN)

( * ) Notice: Subject to any disclaimer, the term of this patent is extended or adjusted under 35 U.S.C. 154(b) by 0 days.

(21) Appl. No.: 18/380,671

(22) Filed: Oct. 17, 2023

(30) Foreign Application Priority Data

Apr. 26, 2023 (CN) ..... 202310457324.7

(51) Int. Cl.

| | |
|---|---|
| ***C22C 1/051*** | (2023.01) |
| ***C22C 29/06*** | (2006.01) |
| ***C22C 29/08*** | (2006.01) |
| ***C22C 29/10*** | (2006.01) |

(52) U.S. Cl.
CPC ..... *C22C 1/051* (2013.01); *C22C 29/067* (2013.01); *C22C 29/08* (2013.01); *C22C 29/10* (2013.01)

(58) Field of Classification Search
CPC ..... C22C 1/051
See application file for complete search history.

(56) References Cited

U.S. PATENT DOCUMENTS 3,971,656 A * 7/1976 Rudy ..... C22C 29/04 75/238
4,778,521 A * 10/1988 Iyori ..... C22C 29/10 75/237

(Continued)

FOREIGN PATENT DOCUMENTS

CN 102046823 A 5/2011

OTHER PUBLICATIONS

Notice of Allowance from CNIPA dated Jun. 12, 2023.

(Continued)

*Primary Examiner* — Christopher S Kessler

(57) ABSTRACT

The invention belongs to the technical field of metal ceramics, in particular to a metal ceramic and a preparation method thereof. The hard phase is formed by at least four kinds of crystal grains with different compositions and shapes; and in the scanning electron microscope photograph of the metal ceramic, it can be observed the first hard phase comprising black titanium nitrocarbide, a thin ring and a thick ring wherein the core phase is pure black; the second hard phase in the form of a dark gray core-ring structure particles; the third hard phase in the form of a high-brightness white core-gray ring; and the fourth hard phase in the form of a homogenous gray phase and off-white core-gray ring structure particles. In addition, a white binder phase can also be observed, and the binder phase is at least one of cobalt and nickel.

5 Claims, 2 Drawing Sheets

(56) References Cited

U.S. PATENT DOCUMENTS

| | | | | |
|---|---|---|---|---|
| 5,766,742 | A * | 6/1998 | Nakamura | C22C 29/04 428/210 |
| 5,856,032 | A * | 1/1999 | Daub | C22C 29/04 75/238 |
| 6,231,277 | B1 * | 5/2001 | Abukawa | C22C 29/04 428/386 |
| 7,762,747 | B2 * | 7/2010 | Taniuchi | C22C 29/04 407/119 |
| 9,499,884 | B2 * | 11/2016 | Jansson | C22C 14/00 |
| 10,570,486 | B2 * | 2/2020 | Kinoshita | C04B 35/64 |
| 10,603,721 | B2 * | 3/2020 | Michiuchi | B23B 27/148 |
| 2010/0089203 | A1 * | 4/2010 | Kinoshita | C22C 29/04 75/238 |

OTHER PUBLICATIONS

First Examination Report from CNIPA dated Jun. 1, 2023.
Allowed Claims in the Notice of Allowance from CNIPA dated Jun. 12, 2023.

* cited by examiner

METAL CERAMIC AND PREPARATION METHOD THEREOF

FIELD OF THE INVENTION

The invention belongs to the technical field of metal ceramics, in particular to a metal ceramic and a preparation method thereof.

BACKGROUND ART

Ti(C,N)-based metal ceramics are made of soft transition metals (Ni, Co) bound with ceramic matrix phases such as TiC, TiN, Ti(C, N) and secondary carbides (such as $Mo_2C$, WC, TaC, and the like). Compared with hard alloy tools, they have better affinity for iron and high temperature strength. It is a composite material with high hardness and high wear resistance, widely used in high-speed precision cutting and machining field for good surface finish.

However, along with the current requirements of the continuous improvement of processing efficiency, ordinary metal ceramics under the high temperature and high-speed cutting conditions, poor chipping resistance is highlighted, prone to sudden chipping thereby reducing the tool life, while affecting the surface finish of the machined parts. In order to obtain the ideal yield strength, red hardness, plastic deformation resistance, wear resistance and other properties, the current metal ceramics used in the preparation of cutting tools for turning and milling steel and their preparation methods still need to be improved.

DISCLOSURE OF INVENTION

In order to solve the problems existing in the prior art, the main purpose of the present invention is to provide a metal ceramic and a preparation method thereof.

In order to solve the above technical problems, according to one aspect of the present invention, the present invention provides the following technical solutions:

A metal ceramic, comprising: a hard phase and a binder phase; wherein the hard phase has not less than 4 kinds, which is at least one of carbides, nitrides, or nitrocarbides and the solid solutions thereof of at least one metal element in Groups IVB, VB, and VIB of the Periodic Table of Elements, comprising:

the first hard phase in the form of a black core, mainly comprising titanium carbide, titanium nitride, and titanium nitrocarbide, and at least 50% of which have a particle size greater than 1 μm;

the second hard phase in the form of a dark gray core-ring structure, mainly comprising titanium carbide, titanium nitride, 1 to 20 wt % niobium carbide and molybdenum carbide, and the above-mentioned nitrocarbide solid solution;

the third hard phase in the form of a high-brightness white core-grey ring structure, mainly comprising tungsten carbide, tantalum carbide, zirconium carbide, and the above-mentioned carbide solid solution, wherein the high-brightness white core is a mixed structure of strip and spherical shape, and at least 50% of the white core have an aspect ratio of greater than 3, and a particle width of less than 0.4 μm; and the fourth hard phase in the form of a gray-white core-gray ring structure, mainly comprising tungsten carbide, titanium carbide, vanadium carbide, titanium nitride, and the above-mentioned nitrocarbide solid solution;

wherein the binder is white and is at least one of cobalt and nickel.

As a preferred embodiment of the metal ceramic according to the present invention, the first hard phase, the second hard phase, and the fourth hard phase are carbides, nitrides, or nitrocarbides and the solid solutions thereof of at least one metal element in Groups IVB, VB, and VIB of the Periodic Table of Elements mainly comprising titanium, and comprising at least one of W, Mo, Ta, Nb, V, Cr, Zr elements with a solid solution ratio of 2 to 50%.

As a preferred embodiment of the metal ceramic according to the present invention, the third hard phase is carbides, nitrides, or nitrocarbides and the solid solutions thereof of at least one metal element in Groups IVB, VB, and VIB of the Periodic Table of Elements mainly comprising titanium, and comprising at least one of W, Mo, Ta, Nb, V, Cr, Zr elements with a solid solution ratio of 50 to 95%.

As a preferred embodiment of the metal ceramic according to the present invention, based on the cross-section of the metal ceramic, the area ratio of the first hard phase is 40 to 70%, and the area ratio of the second hard phase is 5 to 15%, and the area ratio of the third hard phase and/or the fourth hard phase is 20 to 40%, and the rest is the binder phase.

As a preferred embodiment of the metal ceramic according to the present invention, the first hard phase has a composition of a single-phase crystal grain, a partial ring phase, and a phase having a core-ring structure, and comprises, in the scanning electron microscope photograph, the first hard phase 1*a* in the form of a black titanium nitrocarbide, the first hard phase thin ring 1*b* and the first hard phase thick ring 1*c* accounting for 5 to 20% of the area of the first hard phase; wherein the ring-free structure 1*a* and the thin ring 1*b* account for more than 80%, and the particles constituting the first hard phase 1*a* are only composed of Ti(C, N), and the thin ring 1*b* and the thick ring 1*c* are formed by the partial solid solution of the refractory metal carbide around Ti(C, N), with a composition of (Ti, W, Mo)(C, N), (Ti, W, Mo, Nb)(C, N), (Ti, W, Mo, Nb, Zr)(C, N) and the like.

As a preferred embodiment of the metal ceramic according to the present invention, the second hard phase is, in the scanning electron microscope photograph, in the form of a dark gray core-ring structure, and the core-ring structure comprises a composition of a core phase which is formed by the solid solution of 1 to 20 wt % of a composite carbite of at least one metal other than titanium selected from the metals in Groups IVB, VB, and VIB of the Periodic Table of Elements in Ti(C, N), and a ring phase that completely covers the core.

As a preferred embodiment of the metal ceramic according to the present invention, the third hard phase is, in the scanning electron microscope photograph, in the form of a high-brightness white core-gray ring structure, wherein the high-brightness white core phase is a solid solution formed by carbides of at least two metal elements in Groups IVB, VB, and VIB, and wherein the high-brightness white core is a mixed structure of strip and spherical shape, and more than 50% of the white core has an aspect ratio of greater than 3, and a particle width of less than 0.4 μm; and wherein in the gray ring phase, a part of the core and the peripheral part are composed of the same element, and are formed by a composite carbonitride solid solution comprising at least Ti and W. In particular, the W concentration of the core phase is higher than that of the ring phase.

As a preferred embodiment of the metal ceramic according to the present invention, the fourth hard phase has a composition of a single-phase crystal grain and a phase having a core-ring structure, in the scanning electron microscope photograph, in the form of a gray homogeneous structure comprising two structures of the fourth hard phase 4*b* and the off-white core-gray ring fourth hard phase 4*a*. Moreover, in the fourth hard phase, the ratio of the area of the homogeneous structure fourth hard phase 4*b* to the area of the fourth hard phase is 20 to 50%.

In order to solve the above technical problems, according to another aspect of the present invention, the present invention provides the following technical solutions:

A preparation method of the above-mentioned metal ceramic, comprising the steps of:

S1. Powder preparation mixing a hard phase powder, a binder phase powder, a molding agent and a solvent, ball milling, and spray granulation to obtain a mixture;

wherein the hard phase powder is selected from the powders of at least one of carbides, nitrides, or nitrocarbides and the solid solutions thereof comprising at least one of Ti, W, Mo, Ta, Nb, V, Cr, Zr;

wherein the binder phase powder is selected from at least one of Co and Ni powders;

S2. Compression molding compressing the mixture powder to obtain a green compact;

S3. Sintering treatment putting the green compact under a vacuum atmosphere, heating up to the molding agent removal temperature, and removing the molding agent; sintering the green compact from which the molding agent has been removed; performing sintering under high pressure conditions to form the metal ceramic.

As a preferred embodiment of the preparation method of the metal ceramic according to the present invention, the step S3 specifically comprises:

S31. placing the green compact under a vacuum atmosphere, and raising the temperature from room temperature to 1200 to 1350° C.;

S32. under the pressure condition of 1 to 200 mbar, sintering under micro-pressure under at least one process gas of nitrogen and inert gas, and keeping the temperature for 30 to 90 min;

S33. raising to the final sintering temperature of 1400 to 1500° C. at a heating rate of 5 to 10° C./min, and then keeping the temperature in vacuum for 0.5 to 1.0 h;

S34. in at least one process gas of 1 to 10 MPa nitrogen or inert gas, keeping the temperature for 0.5 to 2.0 h at the final sintering temperature;

S35. cooling to 1200° C. at a cooling rate of 3 to 10° C./min under a protective atmosphere of 10 to 200 mbar;

S36. rapid cooling to room temperature to obtain a metal ceramic.

As a preferred embodiment of the preparation method of the metal ceramic according to the present invention, the hard phase powder comprises at least one of titanium-containing cubic phase compound, tungsten carbide, tantalum carbide, vanadium carbide, chromium carbide, zirconium carbide, molybdenum carbide, titanium-containing cubic carbonitride and the solid solution of the above-mentioned carbide or the combination thereof;

the binder phase powder comprises Co and/or Ni powder;

the molding agent comprises paraffin, PEG; and the solvent comprises absolute ethanol and deionized water.

In order to solve the above technical problems, according to another aspect of the present invention, the present invention provides the following technical solutions:

A cutting tool, comprising the above-mentioned metal ceramic as a matrix.

The beneficial effects of the present invention are as follows:

The present invention provides a metal ceramic and its preparation method. The hard phase is formed by at least four kinds of crystal grains with different compositions and shapes; and in the scanning electron microscope photograph of the metal ceramic, it can be observed the first hard phase comprising black titanium nitrocarbide, a thin ring and a thick ring; the second hard phase in the form of a dark gray core-ring structure particles; the third hard phase in the form of a high-brightness white core-gray ring; and the fourth hard phase in the form of a homogenous gray phase and off-white core-gray ring structure particles. In addition, a white binder phase can also be observed, and the binder phase is at least one of cobalt and nickel. A functional composite material with various solid solution structures can be prepared by the preparation method of the invention, which has excellent room temperature toughness, high temperature strength and thermal shock resistance, and can obtain excellent machined surface quality as a cutting material.

BRIEF DESCRIPTION OF DRAWINGS

In order to more clearly illustrate the technical solutions in the embodiments of the present invention or the prior art, the following will briefly introduce the drawings that need to be used in the description of the embodiments or the prior art. Apparently, the accompanying drawings in the following description are only some embodiments of the present invention. For those skilled in the art, other drawings can also be obtained according to the structures shown in these drawings without inventive effort.

Figure 1:
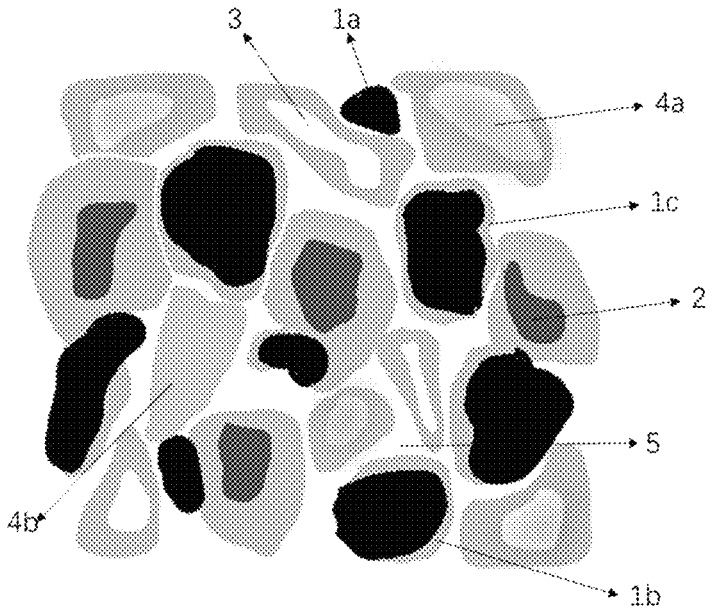
FIG. 1 is the schematic diagram of the metal ceramic of Example 1 of the present invention.

Among them, 1*a*—the first hard phase 1*a*, 1*b*—the first hard phase thin ring 1*b*, 1*c*—the first hard phase thick ring 1*c*, 2—the second hard phase, 3—the third hard phase, 4*a*—fourth hard phase 4*a*, 4*b*—fourth hard phase 4*b*, 5—binding phase.

The realization of the purpose of the present invention, functional characteristics and advantages will be further described in conjunction with the embodiments and with reference to the accompanying drawings.

DETAILED DESCRIPTION OF THE INVENTION

A clear and complete description will be made below in conjunction with the technical solutions in the embodiments. Apparently, the described embodiments are only some of the embodiments of the present invention, but not all of them. Based on the embodiments of the present invention, all other embodiments obtained by persons of ordinary skill in the art without inventive efforts fall within the protection scope of the present invention.

The present invention provides a metal ceramic and its preparation method. The hard phase is formed by at least four kinds of crystal grains with different compositions and shapes; and in the scanning electron microscope photograph of the metal ceramic, it can be observed the first hard phase having a composition of a single-phase crystal grain, a partial ring phase, and a phase having a core-ring structure, wherein the core phase is pure black; the second hard phase in the form of a dark gray core-ring structure particle; the third hard phase in the form of a high-brightness white core-gray ring; and the fourth hard phase in the form of a homogeneous gray phase and off-white core-gray ring structure particles; and in addition, it can also be observed a white binder phase, wherein the binder phase is at least one of cobalt and nickel. A functional composite material with various solid solution structures can be prepared by the preparation method of the invention, which has excellent room temperature toughness, high temperature strength and thermal shock resistance, and can obtain excellent machined surface quality as a cutting material.

According to one aspect of the present invention, the present invention provides following technical solutions:

A metal ceramic, comprising: a hard phase and a binder phase; wherein the hard phase has not less than 4 kinds, which is at least one of carbides, nitrides, or nitrocarbides and the solid solutions thereof of at least one metal element in Groups IVB, VB, and VIB of the Periodic Table of Elements, comprising:

the first hard phase in the form of a black core, mainly comprising titanium carbide, titanium nitride, and titanium nitrocarbide, and at least 50% of which have a particle size greater than 1 μm;

the second hard phase in the form of a dark gray core-ring structure, mainly comprising titanium carbide, titanium nitride, 1 to 20 wt % niobium carbide and molybdenum carbide, and the above-mentioned nitrocarbide solid solution;

the third hard phase in the form of a high-brightness white core-grey ring structure, mainly comprising tungsten carbide, tantalum carbide, zirconium carbide, and the above-mentioned carbide solid solution, wherein the high-brightness white core is a mixed structure of strip and spherical shape, and at least 50% of the white core have an aspect ratio of greater than 3, and a particle width of less than 0.4 μm; and the fourth hard phase in the form of a gray-white core-gray ring structure, mainly comprising tungsten carbide, titanium carbide, vanadium carbide, titanium nitride, and the above-mentioned nitrocarbide solid solution;

wherein the binder is white and is at least one of cobalt and nickel.

Preferably, the first hard phase, the second hard phase, and the fourth hard phase are carbides, nitrides, or nitrocarbides and the solid solutions thereof of at least one metal element in Groups IVB, VB, and VIB of the Periodic Table of Elements mainly comprising titanium, and comprising at least one of W, Mo, Ta, Nb, V, Cr, Zr elements with a solid solution ratio of 2 to 50%. Specifically, the solid solution ratio can be, for example but not limited to, any one of 2%, 5%, 10%, 15%, 20%, 25%, 30%, 35%, 40%, 45%, 50%, or any range therebetween;

Preferably, the third hard phase is carbides, nitrides, or nitrocarbides and the solid solutions thereof of at least one metal element in Groups IVB, VB, and VIB of the Periodic Table of Elements mainly comprising titanium, and comprising at least one of W, Mo, Ta, Nb, V, Cr, Zr elements with a solid solution ratio of 50 to 95%. Specifically, the solid solution ratio can be, for example but not limited to, any one of 50%, 55%, 60%, 65%, 70%, 75%, 80%, 85%, 90%, 95%, or any range therebetween;

Preferably, based on the cross-section of the metal ceramic, the area ratio of the first hard phase is 40 to 70%, and the area ratio of the second hard phase is 5 to 15%, and the area ratio of the third hard phase and/or the fourth hard phase is 20 to 40%, and the rest is the binder phase. Specifically, the area of the first hard phase can be, for example but not limited to, any one of 40%, 45%, 50%, 55%, 60%, 65%, 70% or any range therebetween; and the area of the second hard phase can be, for example but not limited to, any one of 5%, 6%, 7%, 8%, 9%, 10%, 11%, 12%, 13%, 14%, 15%, or any range therebetween; and the area of the third hard phase and/or the fourth hard phase can be, for example but not limited to, any one of 20%, 25%, 30%, 35%, 40% or any range therebetween;

Preferably, the first hard phase has a composition of a single-phase crystal grain, a partial ring phase, and a phase having a core-ring structure, and comprises, in the scanning electron microscope photograph, the first hard phase 1*a* in the form of a black titanium nitrocarbide, the first hard phase thin ring 1*b* and the first hard phase thick ring 1*c* accounting for 5 to 20% of the area of the first hard phase; wherein the ring-free structure 1*a* and the thin ring 1*b* account for more than 80%, and the particles constituting the first hard phase 1*a* are only composed of Ti(C, N), and the thin ring 1*b* and the thick ring 1*c* are formed by the partial solid solution of the refractory metal carbide around Ti(C, N), with a composition of (Ti, W, Mo)(C, N), (Ti, W, Mo, Nb)(C, N), (Ti, W, Mo, Nb, Zr)(C, N) and the like. The first hard phase comprises a large amount of Ti, and thus has high hardness and low reactivity with steels widely used as workpieces. Therefore, the presence of the first hard phase in the metal ceramic enables the improvement of wear resistance and welding resistance.

Preferably, the second hard phase is, in the scanning electron microscope photograph, in the form of a dark gray core-ring structure, and the core-ring structure comprises a composition of a core phase which is formed by the solid solution of 1 to 20 wt % of a composite carbite of at least one metal other than titanium selected from the metals in Groups IVB, VB, and VIB of the Periodic Table of Elements in Ti(C, N), and a ring phase that completely covers the core; wherein the core phase can be, for example, (Ti, W, Ta)(C, N), (Ti, W, Ta, Mo)(C, N), and the like, and the ring phase can be, for example, (Ti, W, Ta, Mo)(C, N), (Ti, W, Ta, Nb, Mo)(C, N), (Ti, W, Mo, Nb)(C, N), (Ti, W, Mo, Nb, Zr)(C, N), and the like. Due to the solid solution of some atoms with high atomic number, the core phase of the second hard phase exhibits a different color contrast from that of the first hard phase under the scanning electron microscope. Different from the first hard phase, the composition difference between the core and ring of the second hard phase is smaller, and the lattice mismatch is lower, which can effectively reduce the internal stress of the metal ceramic. Moreover, there is a peripheral part with good wettability on the entire circumference of the core part, which improves the wettability of the hard phase of the metal ceramic and the binder phase, thereby improving the hardness and density of the product. Thus, the presence of the second hard phase in the metal ceramic can stabilize the effects of wear resistance and fracture resistance in particular.

Preferably, the third hard phase is, in the scanning electron microscope photograph, in the form of a high-brightness white core-gray ring structure, wherein the high-brightness white core phase is a solid solution formed by carbides of at least two metal elements in Groups IVB, VB, and VIB, and wherein the high-brightness white core is a mixed structure of strip and spherical shape, and more than 50% of the white core has an aspect ratio of greater than 3, and a particle width of less than 0.4 μm; wherein the specific composition can be (W, Ta, Ti) C, for example, (W, Ti)C, (W, Ta, Nb, Ti)C, and the like; and wherein in the gray ring phase, a part of the core and the peripheral part are composed of the same element, and are formed by a composite carbonitride solid solution comprising at least Ti and W. The specific composition can be, for example, (Ti, W, Ta, Mo)(C, N), (Ti, W, Ta, Nb, Mo)(C, N), (Ti, W, Mo, Nb)(C, N), (Ti, W, Mo, Nb, Zr)(C, N), and the like. In particular, the W concentration of the core phase is higher than that of the ring phase. Since the third hard phase comprises more W than the first hard phase and the second hard phase, thermal conductivity can be improved while maintaining high hardness, such that thermal strength, heat crack resistance, fracture resistance and plastic deformation resistance can be improved.

Preferably, the fourth hard phase has a composition of a single-phase crystal grain and a phase having a core-ring structure, in the scanning electron microscope photograph, in the form of a gray homogeneous structure comprising two structures of the fourth hard phase 4*b* and the off-white core-gray ring fourth hard phase 4*a*. Moreover, in the fourth hard phase, the ratio of the area of the homogeneous structure fourth hard phase 4*b* to the area of the fourth hard phase is 20 to 50%. The off-white core-gray ring fourth hard phase 4*a* is formed by partial solid solution of elements in the core and peripheral parts, wherein the off-white core phase is formed by carbides of at least one metal element in Groups IVB, VB, and VIB. Due to the lack of pre-solid solution of high atomic number carbides, the content of high atomic number elements (such as W, Ta) in the core of the fourth hard phase 4*a* is lower than that of the core phase in the third hard phase, such that in the scanning electron microscope, it shows a color contrast different from that of the high-brightness white core of the third hard phase. Meanwhile, in the fourth hard phase 4*a*, the W concentration in the core part is higher than that in the peripheral part. The specific composition of the core can be, for example, (Ti, W)(C, N), (Ti, W, Ta, Nb)(C, N), (Ti, W, Nb)(C, N) and the like. The W concentration of the core in the fourth hard phase 4*a* is lower than that of the third hard phase, such that it can maintain high hardness and high thermal conductivity, effectively reduce the lattice mismatch between the core phase and the ring phase, and improve the alloy's heat crack resistance, fracture resistance and plastic deformation resistance. The fourth hard phase 4*b* realizes the homogenization of the composition through the homogenization of the structure, such that it has a single color contrast under the scanning electron microscope. Unlike the third hard phase and the fourth hard phase 4*a*, these particles have no clear boundary between the core and the periphery, and the entire particle has a uniform composition. W is a secondary metal other than Ti that constitutes the fourth hard phase, and its composition can be, for example, (Ti, W)(C, N), (Ti, W, Mo)(C, N), (Ti, W, Nb)(C, N), (Ti, W, Mo, Nb)(C, N). In particular, when the fourth hard phase comprises W, W exists throughout the fourth hard phase. Therefore, the existence of the fourth hard phase in the metal ceramic reduces the hardness slightly, but the hardness becomes uniform, and crack propagation is not easy to occur in the hard phase, and the improvement of thermal conductivity can be expected. Therefore, heat crack resistance and high temperature resistance increased, and fracture resistance can be improved.

According to another aspect of the present invention, the present invention provides the following technical solutions:

A preparation method of the above-mentioned metal ceramic, comprising the steps of:

S1. Powder preparation mixing a hard phase powder, a binder phase powder, a molding agent and a solvent, ball milling, and spray granulation to obtain a mixture;

wherein the hard phase powder is selected from the powders of at least one of carbides, nitrides, or nitrocarbides and the solid solutions thereof comprising at least one of Ti, W, Mo, Ta, Nb, V, Cr, Zr; and the mass of the hard phase powder accounts for 76 to 88 wt % of the total batching mass, wherein the mass of the solid solution powder accounts for 40 to 87.5 wt % of the total batching mass; and specifically, the weight ratio of the hard phase powder to the total batching mass can be, for example but not limited to, any one of 76 wt %, 77 wt %, 78 wt %, 79 wt %, 80 wt %, 81 wt %, 82 wt %, 83 wt %, 84 wt %, 85 wt %, 86 wt %, 87 wt %, 88 wt % or any range therebetween; and the mass of the solid solution powder in the hard phase powder accounts for any one of 40 wt %, 45 wt %, 50 wt %, 55 wt %, 60 wt %, 65 wt %, 70 wt %, 75 wt %, 80 wt %, 85 wt %, 87.5 wt % or any range therebetween, of the total batching mass;

wherein the binder phase powder is selected from at least one of Co and Ni powders; and the mass of the binder phase powder accounts for 12 to 24 wt % of the total batching amount; specifically, the weight ratio of the mass of the binder phase powder to the total batching mass can be, for example, but not limited to any one of 12 wt %, 13 wt %, 14 wt %, 15 wt %, 16 wt %, 17 wt %, 18 wt %, 19 wt %, 20 wt %, 21 wt %, 22 wt %, 23 wt %, 24 wt %, or any range therebetween;

S2. Compression molding compressing the mixture powder to obtain a green compact;

S3. Sintering treatment putting the green compact under a vacuum atmosphere, heating up to the molding agent removal temperature, and removing the molding agent; sintering the green compact from which the molding agent has been removed; performing sintering under high pressure conditions to form the metal ceramic.

As a preferred embodiment of the preparation method of the metal ceramic according to the present invention, wherein: the step S3 specifically comprises:

S31. placing the green compact under a vacuum atmosphere, and raising the temperature from room temperature to 1200 to 1350° C.; wherein specifically, the temperature can be, for example but not limited to, any one of 1200° C., 1220° C., 1250° C., 1280° C., 1300° C., 1330° C., 1350° C., or any range therebetween;

S32. under the pressure condition of 1 to 200 mbar, sintering under micro-pressure under at least one process gas of nitrogen and inert gas, and keeping the temperature for 30 to 90 min; wherein specifically, the pressure can be, for example but not limited to, any one of 1 mbar, 5 mbar, 10 mbar, Any one of 20 mbar, 50 mbar, 100 mbar, 150 mbar, 200 mbar, or any range therebetween; the temperature keeping time can be, for example but not limited to, any one of 30 min, 40 min, 50 min, 60 min, 70 min, 80 min, or any range therebetween;

S33. raising to the final sintering temperature of 1400 to 1500° C. at a heating rate of 5 to 10° C./min, and then keeping the temperature in vacuum for 0.5 to 1.0 h; wherein specifically, the heating rate can be, for example but not limited to, any one of 6° C./min, 7° C./min, 8° C./min, 9° C./min, 10° C./min or any range therebetween; and the final sintering temperature can be, for example but not limited to, any one of 1400° C., 1410° C., Any one of 1420° C., 1430° C., 1440° C., 1450° C., 1460° C., 1470° C., 1480° C., 1490° C., 1500° C. or any range therebetween; and the temperature keeping time can be, for example but not limited to, any one of 0.5 h, 0.75 h, 1.0 h or any range therebetween;

S34. in at least one process gas of 1 to 10 MPa nitrogen or inert gas, keeping the temperature for 0.5 to 2.0 h at the final sintering temperature; wherein specifically, the gas pressure can be, for example but not limited to, any one of 1 MPa, 2 MPa, 3 MPa, 4 MPa, Any one of 5 MPa, 6 MPa, 7 MPa, 8 MPa, 9 MPa, 10 MPa or any range therebetween; and the temperature keeping time can be, for example but not limited to, any one of 0.5 h, 0.75 h, 1.0 h, 1.25 h, 1.5 h, 1.75 h, 2.0 h or any range therebetween;

S35. cooling to 1200° C. at a cooling rate of 3 to 10° C./min under a protective atmosphere of 10 to 200 mbar; and specifically, the pressure of the protective atmosphere can be, for example but not limited to, any one of 10 mbar, 20 mbar, 50 mbar, 100 mbar, 150 mbar, and 200 mbar or any range therebetween; and the cooling rate can be, for example but not limited to, any one of 3° C./min, 4° C./min, 5° C./min, 6° C./min, 7° C./min, 8° C./min, 9° C./min, 10° C./min or any range therebetween;

S36. rapid cooling to room temperature to obtain a metal ceramic.

Preferably, the hard phase powder comprises at least one of titanium-containing cubic phase compound, tungsten carbide, tantalum carbide, vanadium carbide, chromium carbide, zirconium carbide, molybdenum carbide, titanium-containing cubic carbonitride and the solid solution of the above-mentioned carbide or the combination thereof;

the binder phase powder comprises Co and/or Ni powder;

the molding agent comprises paraffin, PEG; and the solvent comprises absolute ethanol and deionized water.

According to another aspect of the present invention, the present invention provides the following technical solutions:

A cutting tool, comprising the above-mentioned metal ceramic as a matrix.

The technical solutions of the present invention will be further described below in conjunction with specific examples.

Example 1

A preparation method of a metal ceramic, comprising:

S1. Powder preparation

Selecting binder phase metal powder, titanium-containing cubic phase compound, tungsten-titanium carbide solid solution $(W_{0.5}, Ti_{0.5})C$, molybdenum carbide, titanium-tungsten-tantalum-niobium carbide solid solution (Ti, W, Ta, Nb)C (wherein, the solid solution mass ratio of W, Ta, Nb was <10%), tungsten carbide as raw materials, with the mass percentage of each raw material of: Co+Ni powder 19 wt %, tungsten-tantalum-niobium-titanium carbide solid solution 9 wt %, molybdenum carbide 2 wt %, titanium-containing cubic carbonitride 53 wt %, tungsten-titanium carbide solid solution 9 wt %, the balance being tungsten carbide, and the sum of the mass percentages of each raw material being 100%, and the powder particle size being <1.8 μm;

Ball milling Co+Ni powder, titanium-tungsten-tantalum-niobium carbide solid solution, tungsten-titanium carbide solid solution, titanium-containing cubic carbonitride, tungsten carbide, molybdenum carbide, the molding agent and the solvent, and using paraffin as molding agent (content 3.0 wt %), using absolute ethanol as the solvent, drying after ball milling, spray granulation to obtain the mixture powder;

S2. Compression molding

Compressing the mixture powder to obtain a green compact; S3. Sintering treatment S31. Placing the compact under a vacuum atmosphere, and raising the temperature from room temperature to 1250° C.;

S32. Under the pressure condition of 50 mbar, micro-pressure sintering under argon, and keeping the temperature for 60 min;

S33. Raising to the final sintering temperature of 1480° C. at a heating rate of 5° C./min, and then keep the temperature in vacuum for 1.5 h;

S34. Keeping the temperature under 6 MPa argon at the final sintering temperature for 1.0 h;

S35. Cooling to 1200° C. at a cooling rate of 5° C./min under 40 mbar argon atmosphere;

S36. Rapid cooling under high pressure to room temperature under an argon atmosphere to obtain a metal ceramic.

The metal ceramic material obtained in Example 1 was cut and shaped to form a blade slab. The cutting edge of the blade was rounded with a nylon brush comprising SiC.

After testing, the blade alloy performance hardness can reach 1480 Hv (10 kg), and the cracking toughness Kic (10 kg) can reach at least 12.5. As shown in FIG. 1, in the internal cross-sectional scanning electron microscope photograph, the area of the first hard phase (including the first hard phase 1*a* 1*a*, the first hard phase thin ring 1*b* 1*b*, 1*c*—the first hard phase thick ring 1*c* 1*c*) is 49%, the area of the second hard phase 2 in the form of a dark gray core-ring structure particle is 7%, the area of the third hard phase 3 in the form of a high-brightness white core-gray ring structure particle is 8%, the area of the fourth hard phase 4 in the form of an off white core-gray ring structure particle (including the fourth hard phase 4*a* 4*a* and the fourth hard phase 4*b* 4*b*) is 16%, and the area of the binder phase 5 is 20%.

Metal ceramics samples were cut by a Discotom hand automatic integrated cutting machine of Denmark STRUERS, and rough grinding was carried out on a vertical grinding and polishing machine. The cutting edge of the rough ground sample was flat. The rough ground sample was placed on a Danish semi-automatic embedding machine model citopresss-20, and then a proper amount of phenolic resin was added for embedding. The embedded samples were fixed on a vertical grinding and polishing machine Abrapol-20 with a fixed disk for grinding and polishing. The course needed to be subjected to grinding treatment by five 300 mm diamond grinding disks of 80 mesh, 220 mesh, 500 mesh, 1200 mesh and 4000 mesh respectively. After the grinding treatment, a 1 μm polishing disk and diamond grinding fluid were used for polishing treatment. After the above steps were completed, the embedded resin around the sample were removed, and then the polishing position of the sample was wiped clean with alcohol cotton, put into the glass vessel containing the sample, introduced with alcohol, and then the glass vessel was put into an ultrasonic cleaner for cleaning. After the sample was cleaned, the sample was blow dry with a blower and coat the conductive film on the ion sputtering instrument. After the sample preparation was completed, it was put into the Zeiss thermal field emission scanning electron microscope sample bin with the model of Supre 55, and imaged in a vacuum environment using 10 KV voltage and backscatter mode.

1. Measurement Method of Particle Size

The image was taken under the magnification of 3000 times. The equivalent circle measurement was carried out on the grain sizes of single-phase grains, partial annular phases and the first hard phase with a core-ring structure which are black in the backscatter mode. The statistical number was 150-200 grains. The average diameter of each grain in the table record was input. The statistical grain size >1 μm accounted for more than 50% of the total grain number.

2. Hard Phase Area Measurement Method

The sample was imaged and photographed under the magnification of 3000 times. The equivalent circle measurement of hard phase size was carried out and the hard phase area was measured.

3. The proportion of ring-free structure 1*a* and thin ring 1*b* in the first hard phase is more than 80%

It referred to the proportion of the number. The sample was imaged and photographed under the magnification of 3000 times, counting the number of 1*a*, 1*b* and 1*c*.

Comparative Example 1

A method of manufacturing a metal ceramic, comprising:

S1. Powder preparation

Selecting binder phase metal powder, titanium-containing cubic phase compound, titanium-tantalum-niobium carbide solid solution (wherein, the solid solution mass ratio of Ta, Nb was <8%), molybdenum carbide, tungsten carbide as raw materials, with the mass percentage of each raw material of: Co+Ni powder 18 wt %, titanium-tantalum-niobium carbide solid solution 15 wt %, molybdenum carbide 2 wt %, titanium-containing cubic carbonitride 40 wt %, the balance being tungsten carbide, and the sum of the mass percentages of each raw material being 100%, and the powder particle size being <2.5 μm;

Ball milling Co+Ni powder, titanium-tantalum-niobium carbide solid solution, tungsten carbide, molybdenum carbide, titanium-containing cubic carbonitride, the molding agent and the solvent, and using paraffin as molding agent (content 3.0 wt %), using absolute ethanol as the solvent, drying after ball milling, spray granulation to obtain the mixture powder;

S2. Compression molding

Compressing the mixture powder to obtain a green compact;

S3. Sintering treatment S31. Placing the compact under a vacuum atmosphere, and raising the temperature from room temperature to 1250° C.;

S32. Under the pressure condition of 50 mbar, micro-pressure sintering under argon, and keeping the temperature for 90 min;

S33. Raising to the final sintering temperature of 1450° C. at a heating rate of and then keep the temperature in vacuum for 0.5 h;

S34. Keeping the temperature under 6 MPa argon at the final sintering temperature for 1.0 h;

S35. Cooling to 1200° C. under vacuum condition;

S36. Rapid cooling to room temperature to obtain a metal ceramic.

The metal ceramic material obtained in Comparative Example 1 was cut and shaped to form a blade slab. The cutting edge of the blade was rounded with a nylon brush comprising SiC.

Figure 2:
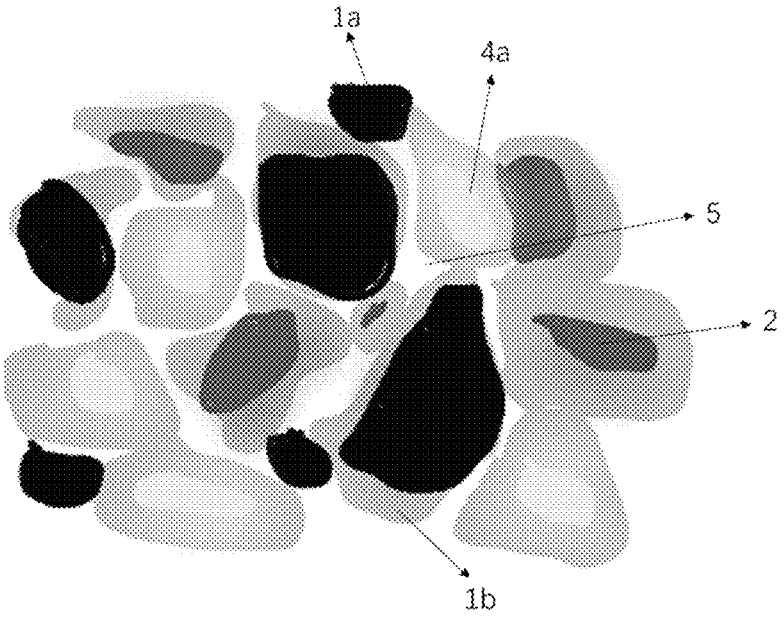
FIG. 2 is the schematic diagram of the metal ceramic of Comparative Example 1 of the present invention.

After testing, the blade alloy performance hardness can reach 1400 Hv (10 kg), and the cracking toughness Kic (10 kg) can reach near 12. As shown in FIG. 2, in the internal cross-sectional scanning electron microscope photograph, the area of the first hard phase (including the first hard phase 1*a* 1*a*, and the first hard phase thin ring 1*b* 1*b*) is 58%, the area of the second hard phase 2 in the form of a dark gray core-ring structure particle is 5%, the area of the fourth hard phase 4 in the form of an off white core-gray ring structure particle is 20%, and the area of the binder phase 5 is 17%.

Comparative Example 2

A method of manufacturing a metal ceramic, comprising:

S1. Powder preparation

Selecting binder phase metal powder, titanium-containing cubic phase compound, tungsten-titanium carbide solid solution $(W_{0.5}, Ti_{0.5})C$, molybdenum carbide, tungsten carbide as raw materials, with the mass percentage of each raw material of: Co+Ni powder 18 wt %, tungsten-titanium carbide solid solution 20 wt %, molybdenum carbide 2 wt %, titanium-containing cubic carbonitride 55 wt %, the balance being tungsten carbide, and the sum of the mass percentages of each raw material being 100%, and the powder particle size being <2.5 μm;

Ball milling Co+Ni powder, tungsten-titanium carbide solid solution, titanium-containing cubic carbonitride, tungsten carbide, molybdenum carbide, the molding agent and the solvent, and using paraffin as molding agent (content 3.0 wt %), using absolute ethanol as the solvent, drying after ball milling, spray granulation to obtain the mixture powder;

S2. Compression molding

Compressing the mixture powder to obtain a green compact;

S3. Sintering treatment

S31. Placing the compact under a vacuum atmosphere, and raising the temperature from room temperature to 1250° C.;

S32. Under the pressure condition of 50 mbar, micro-pressure sintering under argon, and keeping the temperature for 90 min;

S33. Raising to the final sintering temperature of 1450° C. at a heating rate of 6° C./min, and then keep the temperature in vacuum for 1.5 h;

S34. Keeping the temperature under vacuum condition at the final sintering temperature for 1.0 h;

S35. Cooling to 1200° C. at a cooling rate of 5° C./min under 40 mbar argon atmosphere;

S36. Rapid cooling under high pressure to room temperature under an argon atmosphere to obtain a metal ceramic.

The metal ceramic material obtained in Comparative Example 2 was cut and shaped to form a blade slab. The cutting edge of the blade was rounded with a nylon brush comprising SiC.

Figure 3:
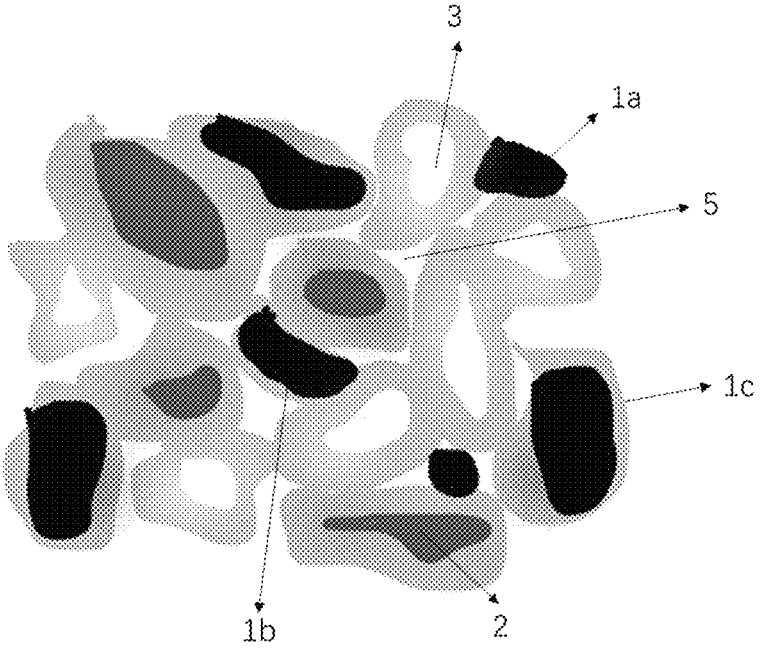
FIG. 3 is the schematic diagram of the metal ceramic of Comparative Example 2 of the present invention.

After testing, the blade alloy performance hardness can reach 1390 Hv (10 kg), and the cracking toughness Kic (10 kg) can reach near 12. As shown in FIG. 3, in the internal cross-sectional scanning electron microscope photograph, the area of the first hard phase (including the first hard phase 1*a* 1*a*, and the first hard phase thin ring 1*b* 1*b*) is 59%, the area of the second hard phase 2 in the form of a dark gray core-ring structure particle is 5%, the area of the third hard phase 3 in the form of a high-brightness white core-gray ring structure particle is 21%, and the area of the binder phase 5 is 15%.

Comparative Example 3

Figure 4:
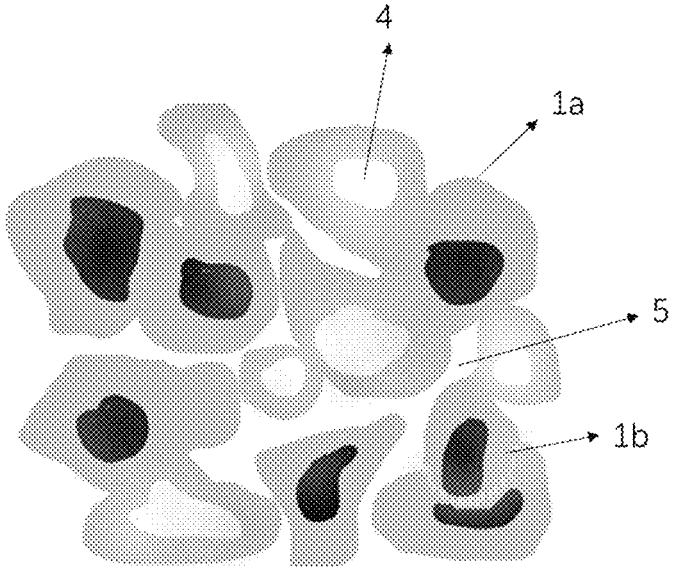
FIG. 4 is the schematic diagram of the metal ceramic of Comparative Example 3 of the present invention.

The ratio of each element of the raw material components was the same as that of Comparative Example 2, with the difference that only individual carbides of tungsten, niobium, and molybdenum were used, and the temperature was raised to 1480° C. under vacuum condition, and the process was carried out under a high-pressure argon atmosphere of 5 MPa at 1480° C. to keep the temperature and sinter for 0.5 h. As shown in FIG. 4, a metal ceramic matrix with only black core-gray ring and white core-gray ring was prepared. Then, wet sandblasting was performed on the metal ceramic blade matrix at an angle of 45° to the rake face of the blade, to round the edge of the blade and finally form a cutting blade.

Comparative Example 4

The ratio of each element of the raw material components was the same as that of Comparative Example 1, with the difference that only individual carbides of tungsten, tantalum, and molybdenum were used, and the temperature was raised to 1480° C. under vacuum condition, and the process was carried out under a high-pressure argon atmosphere of 5 MPa at 1480° C. to keep the temperature and sinter for 0.5 h. As shown in FIG. 4, a metal ceramic matrix with only black core-gray ring and white core-gray ring was prepared. Then, wet sandblasting was performed on the metal ceramic blade matrix at an angle of 45° to the rake face of the blade, to round the edge of the blade and finally form a cutting blade.

The comparative test data and test results of above-mentioned Example 1 and Comparative Examples 1, 2, 3, 4 under different cutting conditions are as follows:

Longitudinal turning of 40CrNi2Mo steel bar was carried out to compare and test the wear resistance of the above blades. The blade life standard was the machining time when the flank wear is 0.3 mm Cutting conditions are shown in Table 1:

TABLE 1

| Material | 40CrNi2Mo (HB210-220) |
|---|---|
| Cutting rate | 200 m/min;<br>300 m/min |
| Feeding amount | 0.15 mm |
| Cutting depth | 0.1 m |
| Cutting fluid | None |

The test results are detailed in Table 2:

TABLE 2

| Tested Product | Cutting life time (min) | |
|---|---|---|
| Cutting parameter | 200 m/min | 300 m/min |
| Example 1 | 54.2 | 45.8 |
| Comparative Example 1 | 48.2 | 39.0 |
| Comparative Example 2 | 47.6 | 38.8 |
| Comparative Example 3 | 31.0 | 22.5 |
| Comparative Example 4 | 34.4 | 28.6 |

The results showed that:

In the high-speed turning of steel, the Example of the present invention achieved good interface matching between the hard phase and the binder phase by preparing a multi-hard phase composite structure Ti(C, N)-based metal ceramic material, and at the same time made the alloy have excellent high-temperature hardness and thermal conductivity, thereby improving the high-temperature wear resistance of the blade.

Blade failure criteria were edge chipping, plastic deformation, and excessive wear (flank wear≥0.3 mm).

A cylindrical four-slotted bar was cut longitudinally to test the impact resistance of the above inserts. The blade life standard was the impact time when the blade peels off or chipping.

Cutting conditions are detailed in Table 3:

TABLE 3

| Material | 40CrNi2Mo (HB210-220) |
|---|---|
| Cutting rate | 180 m/min |
| Feeding amount | 0.15 mm |
| Cutting depth | 1.0 mm |
| Cutting fluid | None |

The test results are shown in Table 4:

TABLE 4

| Tested Product | Cutting life time (min) | Failure Manner |
|---|---|---|
| Example 1 | 33.4 | excessive wear |
| Comparative Example 1 | 27.2 | excessive wear |
| Comparative Example 2 | 25.8 | excessive wear |
| Comparative Example 3 | 16.2 | chipping edge of the blade tip |
| Comparative Example 4 | 19.8 | excessive wear |

The test results show that: in the discontinuous and high-speed processing of steel, the impact resistance and the toughness of the blade tip of the Example of the present invention and the comparative product were significantly improved. It can thus be proved that the cutting blade according to the Example of the present invention can effectively improve the room temperature toughness and high temperature thermal shock resistance of the material.

The above description is only a preferred embodiment of the present invention, and does not limit the patent scope of the present invention. Under the inventive concept of the present invention, the equivalent structural transformation made by using the content of the description of the present invention, or directly/indirectly used in other related all technical fields are comprised in the patent protection scope of the present invention.

What is claimed is:

1. A metal ceramic, characterized in comprising: a hard phase and a binder phase;

wherein the hard phase has not less than 4 kinds, which is at least one of carbides, nitrides, or nitrocarbides and the solid solutions thereof of at least one metal element in Groups IVB, VB, and VIB of the Periodic Table of Elements, comprising:

the first hard phase in the form of a black core, mainly comprising titanium carbide, titanium nitride, and titanium nitrocarbide, and in the scanning electron microscope photograph, at least 50% of which have a particle size greater than 1 μm; wherein the first hard phase has a composition of a single-phase crystal grain, a partial ring phase, and a phase having a core-ring structure, and comprises, in the scanning electron microscope photograph, the first hard phase 1*a* in the form of a black titanium nitrocarbide, the first hard phase thin ring 1*b* and the first hard phase thick ring 1*c* accounting for 5 to 20% of the area of the first hard phase; wherein the ring-free structure 1*a* and the thin ring 1*b* account for more than 80%, and the particles constituting the first hard phase 1*a* are only composed of Ti(C, N), and the thin ring 1*b* and the thick ring 1*c* are formed by the partial solid solution of the refractory metal carbide around Ti(C, N);

the second hard phase in the form of a dark gray core-ring structure, mainly comprising titanium carbide, titanium nitride, 1 to 20 wt % niobium carbide and molybdenum carbide, and the above-mentioned nitrocarbide solid solution; wherein the second hard phase is, in the scanning electron microscope photograph, in the form of a dark gray core-ring structure, and the core-ring structure comprises a composition of a core phase which is formed by the solid solution of 1 to 20 wt % of a composite carbite of at least one metal other than titanium selected from the metals in Groups IVB, VB, and VIB of the Periodic Table of Elements in Ti(C, N), and a ring phase that completely covers the core;

the third hard phase in the form of a high-brightness white core-grey ring structure, mainly comprising tungsten carbide, tantalum carbide, zirconium carbide, and the above-mentioned carbide solid solution, wherein the third hard phase is, in the scanning electron microscope photograph, in the form of a high-brightness white core-gray ring structure, wherein the high-brightness white core phase is a solid solution formed by carbides of at least two metal elements in Groups IVB, VB, and VIB, and wherein the high-brightness white core is a mixed structure of strip and spherical shape, and more than 50% of the white core has an aspect ratio of greater than 3, and a particle width of less than 0.4 μm; and wherein in the gray ring phase, a part of the core and the peripheral part are composed of the same element, and are formed by a composite carbonitride solid solution comprising at least Ti and W; and the W concentration of the core phase is higher than that of the ring phase; and the fourth hard phase in the form of a gray-white core-gray ring structure, mainly comprising tungsten carbide, titanium carbide, vanadium carbide, titanium nitride, and the above-mentioned nitrocarbide solid solution; wherein the fourth hard phase has a composition of a single-phase crystal grain and a phase having a core-ring structure, in the scanning electron microscope photograph, in the form of a gray homogeneous structure comprising two structures of the fourth hard phase 4*b* and the off-white core-gray ring fourth hard phase 4*a*; and in the fourth hard phase, the ratio of the area of the homogeneous structure fourth hard phase 4*b* to the area of the fourth hard phase is 20 to 50%;

wherein the binder is white and is at least one of cobalt and nickel.

2. The metal ceramic according to claim 1, characterized in that, based on the cross-section of the metal ceramic, the area ratio of the first hard phase is 40 to 70%, and the area ratio of the second hard phase is 5 to 15%, and the area ratio of the third hard phase and/or the fourth hard phase is 20 to 40%, and the rest is the binder phase.

3. A preparation method of the metal ceramic according to claim 1, comprising the steps of:

S1. powder preparation mixing a hard phase powder, a binder phase powder, a molding agent and a solvent, ball milling, and spray granulation to obtain a mixture;

wherein the hard phase powder is selected from the powders of at least one of carbides, nitrides, or nitrocarbides and the solid solutions thereof comprising at least one of Ti, W, Mo, Ta, Nb, V, Cr, Zr;

wherein the binder phase powder is selected from at least one of Co and Ni powders;

S2. compression molding compressing the mixture powder to obtain a green compact;

S3. sintering treatment putting the green compact under a vacuum atmosphere, heating up to the molding agent removal temperature, and removing the molding agent; sintering the green compact from which the molding agent has been removed; performing sintering under high pressure conditions to form the metal ceramic.

4. The preparation method of the metal ceramic according to claim 3, characterized in that the step S3 specifically comprises:

S31. placing the green compact under a vacuum atmosphere, and raising the temperature from room temperature to 1200 to 1350° C.;

S32. under the pressure condition of 1 to 200 mbar, sintering under micro-pressure under at least one process gas of nitrogen and inert gas, and keeping the temperature for 30 to 90 min;

S33. raising to the final sintering temperature of 1400 to 1500° C. at a heating rate of 5 to 10° C./min, and then keeping the temperature in vacuum for 0.5 to 1.0 h;

S34. in at least one process gas of 1 to 10 MPa nitrogen or inert gas, keeping the temperature for 0.5 to 2.0 h at the final sintering temperature;

S35. cooling to 1200° C. at a cooling rate of 3 to 10° C./min under a protective atmosphere of 10 to 200 mbar;

S36. rapid cooling to room temperature to obtain a metal ceramic.

5. A cutting tool, comprising the metal ceramic according to claim 1.

* * * * *